US010288393B2

(12) United States Patent
Corrado

(10) Patent No.: US 10,288,393 B2
(45) Date of Patent: May 14, 2019

(54) FLIGHT VEHICLE WITH CONTROL SURFACES USABLE AS MOMENTUM WHEELS

(71) Applicant: Raytheon Company, Waltham, MA (US)

(72) Inventor: Joseph R. Corrado, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 327 days.

(21) Appl. No.: 15/229,275

(22) Filed: Aug. 5, 2016

(65) Prior Publication Data

US 2018/0038671 A1 Feb. 8, 2018

(51) Int. Cl.
*F42B 10/14* (2006.01)
*F42B 10/64* (2006.01)

(52) U.S. Cl.
CPC ..... *F42B 10/14* (2013.01); *F42B 10/64* (2013.01)

(58) Field of Classification Search
CPC ..... F42B 10/14; F42B 10/64
See application file for complete search history.

(56) References Cited

U.S. PATENT DOCUMENTS

| | | | | |
|---|---|---|---|---|
| 3,756,538 | A * | 9/1973 | McLean | F41G 7/2213 114/24 |
| 5,379,968 | A * | 1/1995 | Grosso | F42B 10/661 244/3.21 |
| 7,273,067 | B2 * | 9/2007 | Quitmeyer | F16K 31/047 137/553 |
| 7,354,017 | B2 * | 4/2008 | Morris | F42B 10/54 102/501 |
| 8,356,775 | B2 | 1/2013 | Mintz et al. | |
| 9,939,238 | B1 * | 4/2018 | Sowle | F42B 10/26 |
| 2004/0164202 | A1 | 8/2004 | Klestadt et al. | |
| 2013/0277494 | A1 * | 10/2013 | Rastegar | F42B 10/18 244/3.24 |

* cited by examiner

*Primary Examiner* — Justin M Benedik
(74) *Attorney, Agent, or Firm* — Renner, Otto, Boisselle & Sklar, LLP

(57) ABSTRACT

A flight vehicle, such as a missile, operates both atmospherically and exo-atmospherically. The flight vehicle has control surfaces which are able to rotate relative to a fuselage of the flight vehicle, with the control surfaces extending outside of the fuselage into the airstream (or space) around the fuselage. The control surfaces may be used to control attitude in both atmospheric flight and exo-atmospheric flight. In atmospheric flight the control surfaces operate conventionally, with the aerodynamic forces on the control surfaces creating a torque on the flight vehicle. The control surfaces may be selectively positioned, such as by use of actuators, to achieve the desired torque on the flight vehicle, to achieve the desired attitude. In exo-atmospheric flight the control surfaces can be used as momentum wheels, with the control surfaces selectively rotated to produce a reaction torque on the fuselage.

19 Claims, 5 Drawing Sheets

FLIGHT VEHICLE WITH CONTROL SURFACES USABLE AS MOMENTUM WHEELS

FIELD OF THE INVENTION

The invention relates to attitude control of flight vehicles and parts of flight vehicles.

DESCRIPTION OF THE RELATED ART

Tactical missiles are being used at higher altitudes, altitudes in which the atmosphere is too thin to use control surfaces to produce aerodynamic forces to adjust the attitude and/or steer the missile.

SUMMARY OF THE INVENTION

A flight vehicle, such as a missile, has control surfaces that can be positioned conventionally to produce aerodynamic forces to produce torque to adjust attitude within atmosphere. The control surfaces can also be rotated to operate as rotation wheels or momentum wheels, to provide attitude adjustment to the fuselage of the flight vehicle, such as when the flight vehicle is at an exo-atmospheric altitude.

According to an aspect of the invention, a flight vehicle includes: a fuselage; control surfaces extending outside of the fuselage; and a controller operatively coupled to the control surfaces. The control surfaces are each able to rotate relative to the fuselage about a respective rotation axis. The controller is capable of using the control surfaces as momentum wheels, selectively rotating the control surfaces to change attitude of the fuselage.

According to an embodiment of any paragraph(s) of this summary, the control surfaces are capable of fully rotating about the respective rotation axes.

According to an embodiment of any paragraph(s) of this summary, the control surfaces include fins.

According to an embodiment of any paragraph(s) of this summary, the control surfaces extend out from a forward part of the fuselage.

According to an embodiment of any paragraph(s) of this summary, the control surfaces extend out from an aft part of the fuselage.

According to an embodiment of any paragraph(s) of this summary, the controller also is capable of selectively commanding changes in position of the control surfaces relative to the fuselage, during atmospheric flight.

According to an embodiment of any paragraph(s) of this summary, the flight vehicle further includes actuators that receive commands from the controller, and control movement of the control surfaces relative to the fuselage.

According to an embodiment of any paragraph(s) of this summary, the actuators include electric motors operatively coupled to respective of the control surfaces, to rotate the control surfaces relative to the fuselage.

According to an embodiment of any paragraph(s) of this summary, at least some of the control surfaces are able to change configuration during flight to increase moments of inertia of the at least some of the control surfaces, about the rotation axes of the at least some of the control surfaces.

According to an embodiment of any paragraph(s) of this summary, each of the at least some of the control surfaces includes a base, and at least one panel hingedly coupled to the base.

According to an embodiment of any paragraph(s) of this summary, the flight vehicle is a missile.

According to an embodiment of any paragraph(s) of this summary, the flight vehicle is configured to fly both atmospherically and exo-atmospherically.

According to another aspect of the invention, a flight vehicle includes: a fuselage; and an attitude control system that includes: control surfaces extending outside of the fuselage; actuators operatively coupled to respective of the control surfaces, to selectively rotate the control surfaces relative to the fuselage about respective rotation axes; and a controller operatively coupled to the actuators. The attitude control system is configured to selectively operate in an atmospheric mode or an exo-atmospheric mode, such that: when the attitude control system is in atmospheric mode, the attitude control system selectively changes attitude of the flight vehicle by selectively changing positions of the control surfaces, to allow aerodynamic forces to put a torque on the flight vehicle; and when the attitude control system is in exo-atmospheric mode, the attitude control system selectively changes attitude of the fuselage by selectively rotating the control surfaces, to thereby put a torque on the fuselage as a direct reaction to the rotating of the control surfaces.

According to yet another aspect of the invention, a method of operating a flight vehicle includes the steps of: atmospherically flying the vehicle; and exo-atmospherically flying the vehicle. Atmospherically flying the flight vehicle includes controlling attitude of the flight vehicle by selectively changing positions of control surfaces of the flight vehicle, to cause aerodynamic forces to put a torque on the flight vehicle. Exo-atmospherically flying the flight vehicle includes controlling attitude of a fuselage of the flight vehicle by selectively rotating the control surfaces, to thereby put a torque on the fuselage as a direct reaction to the rotating of the control surfaces.

According to an embodiment of any paragraph(s) of this summary, during the exo-atmospherically flying of the flight vehicle, the selectively rotating the control surfaces causes the control surfaces to operate as momentum wheels.

According to an embodiment of any paragraph(s) of this summary, during the exo-atmospherically flying of the flight vehicle, the selectively rotating the control surfaces includes selectively fully rotating the control surfaces about respective rotation axes of the control surfaces.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A flight vehicle, such as a missile, operates both atmospherically and exo-atmospherically. The flight vehicle has control surfaces which are able to rotate relative to a fuselage of the flight vehicle, with the control surfaces extending outside of the fuselage into the airstream (or space) around the fuselage. The control surfaces may be used to control attitude in both atmospheric flight and exo-atmospheric flight. In atmospheric flight the control surfaces operate conventionally, with the aerodynamic forces on the control surfaces (drag and/or lift) creating a torque on the flight vehicle that changes its attitude. The control surfaces may be selectively positioned, such as by use of actuators, to achieve the desired torque on the flight vehicle, to achieve the desired attitude. In exo-atmospheric flight the control surfaces can be used as momentum wheels, with the control surfaces selectively rotated to produce a reaction torque on the fuselage, with the angular momentum of the flight vehicle being conserved. The same actuators, for example electric motors, may be used to move the control surfaces for both atmospheric and exo-atmospheric attitude control. The control surfaces are parts of an attitude control system that controls movement of the control surfaces, as well as shifting between atmospheric and exo-atmospheric modes of operation. The control surfaces may be able to fully rotate relative to the fuselage about respective axes, or may be only capable of partial rotation. The control surfaces may be fins and/or other types of control surfaces. The control surfaces may be on the forward part of the fuselage and/or may be on the aft part of the fuselage. The control surfaces may be able to change configuration during flight to increase their moments of inertia, to improve operation as momentum wheels. The use of the same control surfaces and the same actuators for accomplishing attitude control in both atmospheric flight and exo-atmospheric flight may result in more efficient operation, as well as savings in weight, space, and/or cost.

Figure 1:
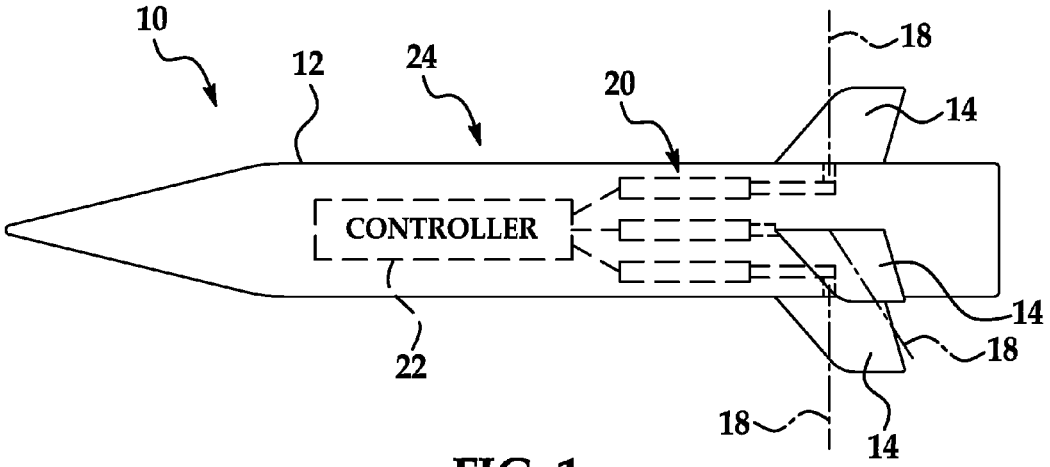
FIG. 1 is a schematic side view of a flight vehicle according to an embodiment of the present invention.

FIG. 1 shows a flight vehicle 10 that has a fuselage 12, and control surfaces 14 that extend outside of the fuselage 12. In the illustrated embodiment the flight vehicle 10 is a missile, and the control surfaces 14 are fins on an aft part of the fuselage 12, but other types of flight vehicles and other fuselage locations for the control surfaces 14 may be used instead.

The control surfaces 14 are adjustable, able to be rotated relative to the fuselage 12 about respective rotation axes 18. Movement of the control surfaces 14 is accomplished by a series of actuators 20, with each of the control surfaces 14 being operatively coupled to a respective one of the actuators 20. The actuators 20 are in turn controlled by a controller 22. The controller 22 may be, or may include, a computer or integrated circuit, with hardware and/or software for controlling or providing control signals to the actuators 20. The operations of the controller 22 may be electronic, electrical, mechanical, or some combination of these. The controller 22 may interact with other systems of the flight vehicle, such as a communication system or a sensor system (both not shown), which provide information on a course that the flight vehicle 10 is to follow, and/or on an attitude (orientation relative to an external (fixed) frame of reference) that it would be desirable for the flight vehicle to attain or maintain. The other systems may also perform other functions, and/or may provide other information to the controller 22.

The control surfaces 14, the actuators 20, and the controller 22 are all parts of an attitude control system 24, which controls the attitude of the flight vehicle 10 in general, or of a main part of the flight vehicle 10, such as the fuselage 12. The attitude control system 24 may also have other functions, such as steering the flight vehicle 10, or may be part of a larger system that performs other functions.

The attitude control system 24 is configured to operate both in atmospheric and exo-atmospheric conditions. The line between atmospheric and exo-atmospheric conditions may depend on the configuration of the vehicle in question, since for example a vehicle with larger fins would most likely be able to go to higher altitudes before needing to switch to exo-atmospheric mode. Roughly speaking, the line between atmospheric and exo-atmospheric conditions may be at the altitude at which the torques generated by using the control surfaces as momentum wheels is larger than the torques generated by the aerodynamic forces on the control surfaces. In atmospheric conditions the attitude control system 24 operates in a conventional sense, using aerodynamic forces to change the attitude of the flight vehicle 10. The actuators 20 may be commanded to selectively position the control surfaces 14 to cause aerodynamic forces, such as lift and/or drag, to place a torque on the flight vehicle 10. This torque may be used to change the attitude of the flight vehicle 10, causing the flight vehicle 10 to pitch, roll, and/or yaw. This type of operation is the atmospheric mode of operation of the attitude control system 24.

In the exo-atmospheric mode of operation the attitude control system 24 uses the control surfaces 14 as momentum wheels or reaction wheels. In such operation the control surfaces 14 are selectively rotated relative to the fuselage 12. This rotation of the control surfaces 14 causes a corresponding change in the attitude of the fuselage 12, as the combined angular momentum of the fuselage 12 and the control surfaces 14 is conserved.

Figure 2:
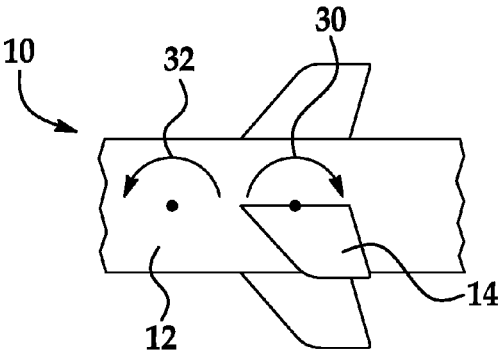
FIG. 2 is a side view showing part of the flight vehicle of FIG. 1, with one of the control surfaces being used as a momentum wheel.

With reference in addition to FIG. 2, as one of the control surfaces 14 is rotationally accelerated about its rotation axis 18 in a clockwise direction (indicated by reference number 30), a corresponding torque is felt by the fuselage 12 to cause rotation in the opposite direction, indicated by reference number 32. The torque to rotationally accelerate the control surface 14 is related to the torque on the fuselage 12 as follows:

$$I_{cs}\alpha_{cs}=I_f\alpha_f \quad (1)$$

where $\alpha_{cs}$ and $\alpha_f$ are the rotational accelerations of the control surface 14 and the fuselage 12 about the control surface rotation axis 18, and $I_{cs}$ and $I_f$ are the moments of inertia of the control surface 14 and the fuselage 12 about the control surface rotation axis 18. Angular momentum of the combined system of the control surface 14 and the fuselage 12 (including other of the control surfaces 14 that are not being moved) is conserved as well:

$$I_{cs}\omega_{cs}=I_f\omega_f \quad (2)$$

where $\omega_{cs}$ and $\omega_f$ are the respective angular velocities of the control surface 14 and the fuselage 12, both about the control surface rotation axis 18.

Since the fuselage 12 is much heavier than the control surface 14, and extends much farther away from the control surface rotation axis 18 than does the control surface 14, it is expected that rotational accelerations and velocities in the control surface 14 will produce much smaller rotational accelerations and velocities in the fuselage 12. The proportion between accelerations of the control surface 14 and corresponding accelerations of the fuselage 12 may be three or four orders of magnitude, to give a non-limiting example ratio range. The actual ratio for a given flight vehicle may be larger or smaller than this range.

FIGS. 3A-3F shows graphs of an example of operation of the control surface 14 to cause a change in attitude (an angular movement) of the fuselage 12. The values shown in the graphs of FIGS. 3A-3F are only those for one particular example, which is not limiting or necessarily representative.

Figure 3A:
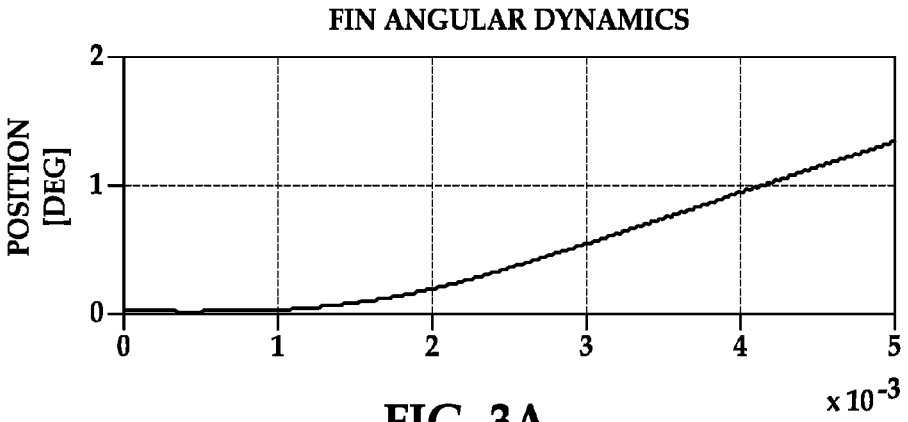
FIG. 3A shows a first graph illustrating an example of operation of the control surface as a momentum wheel.
Figure 3B:
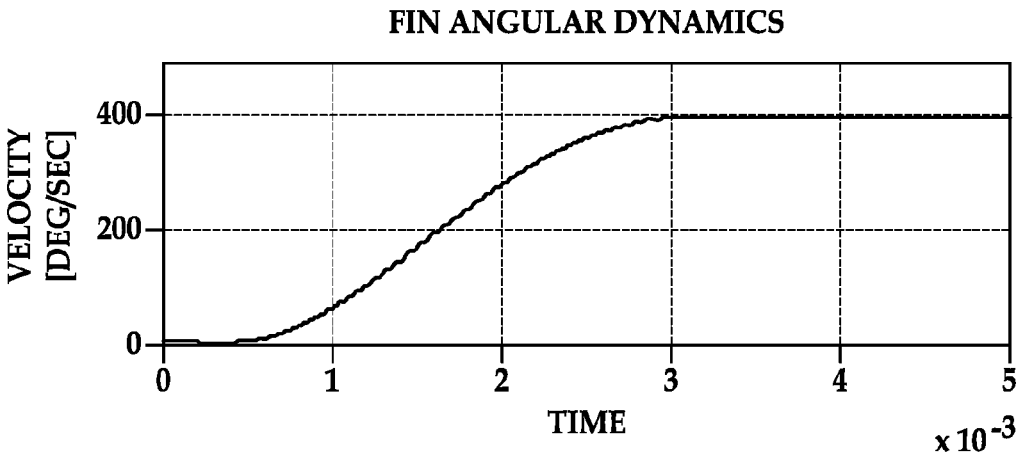
FIG. 3B shows a second graph illustrating the example of operation of the control surface as a momentum wheel.
Figure 3C:
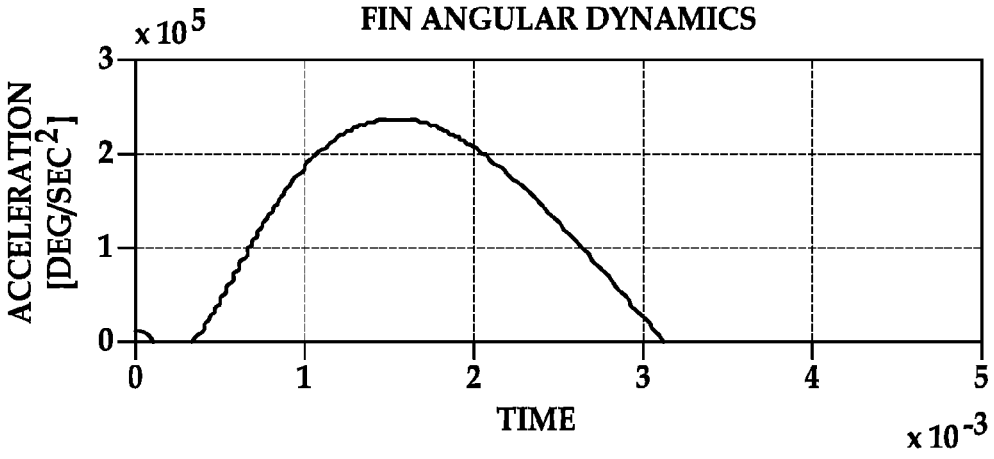
FIG. 3C shows a third graph illustrating the example of operation of the control surface as a momentum wheel.
Figure 3D:
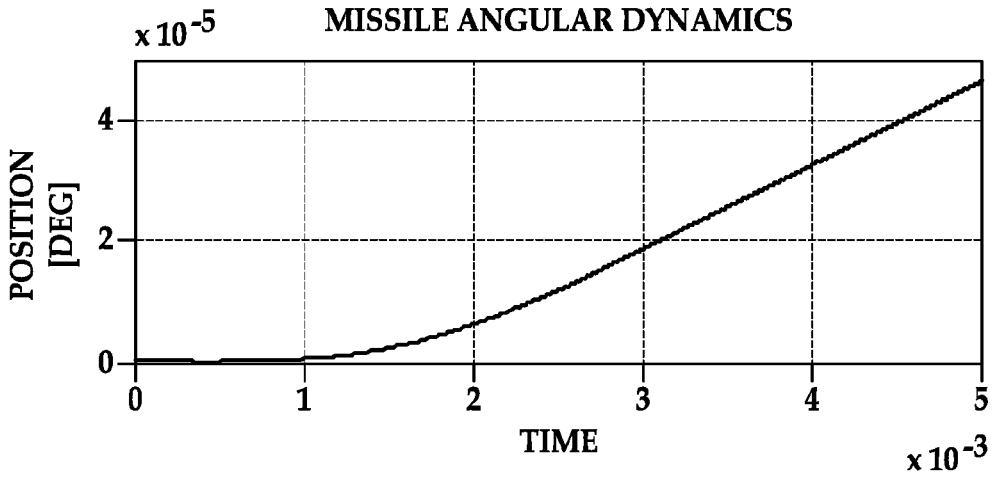
FIG. 3D shows a fourth graph illustrating the example of operation of the control surface as a momentum wheel.
Figure 3E:
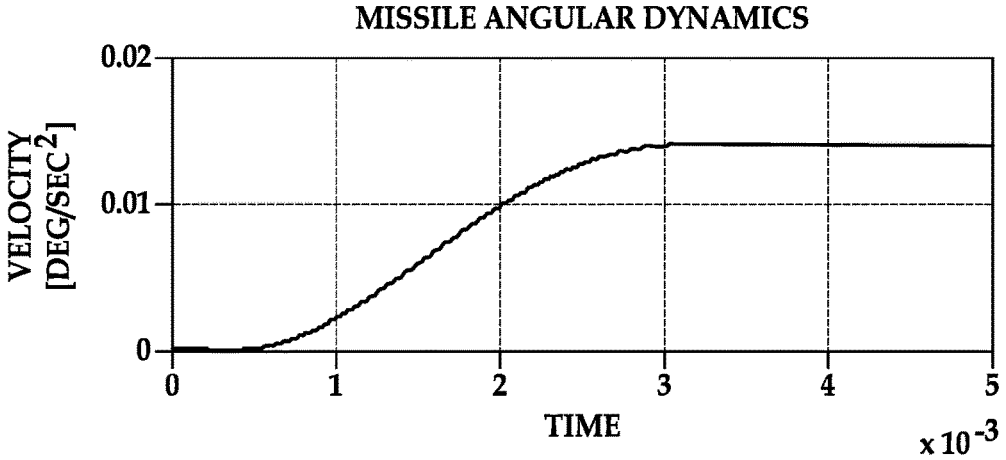
FIG. 3E shows a fifth graph illustrating the example of operation of the control surface as a momentum wheel.
Figure 3F:
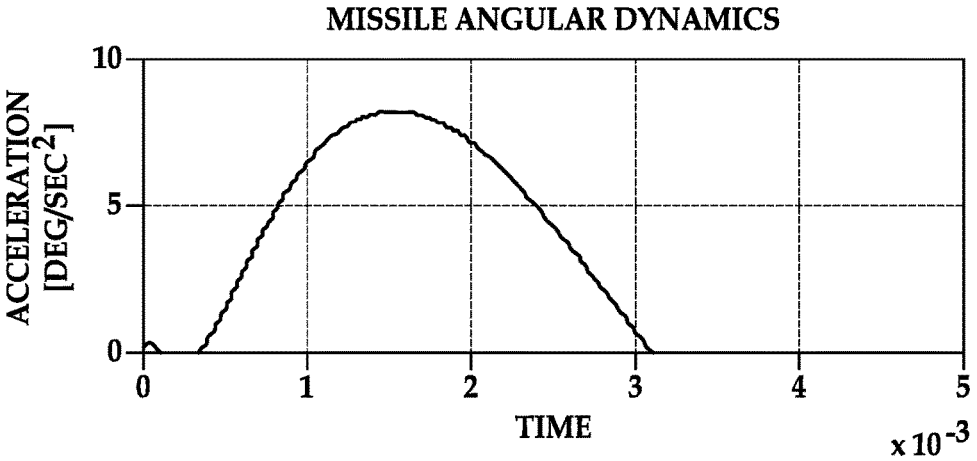
FIG. 3F shows a sixth graph illustrating the example of operation of the control surface as a momentum wheel.

As the control surface 14 accelerates from rest (FIG. 3C) it causes an angular velocity to ramp up (FIG. 3B), which results in change of angular position of the control surface 14 (FIG. 3A). All of these changes are mirrored in the corresponding angular accelerations, angular velocities, and angular positions of the fuselage 12 (FIGS. 3D-3F), although at much lower levels.

The input acceleration to the control surface 14 in the graphs of FIG. 3A-3F is in the nature of a pulse, with acceleration quickly applied and then removed. In the example the acceleration is applied over a period of about 3 milliseconds, increasing the angular velocity of both the control surface 14 and the fuselage 12 to substantially constant levels. The angular velocities of the control surface 14 and the fuselage 12 are maintained as long as no further torque is placed on control surface 14 or the fuselage 12.

Since the angular movement of the fuselage 12 may be so much slower than the angular movement of the control surface 14 that is used to cause it, it may be desirable for control surface 14 to be able to rotate fully about the rotation axis 18. This avoids any sort of stop that would limit the angular travel of the control surface 14. Alternatively the control surface 14 may have a stop or stops that limit its travel, as described further below.

Figure 4:
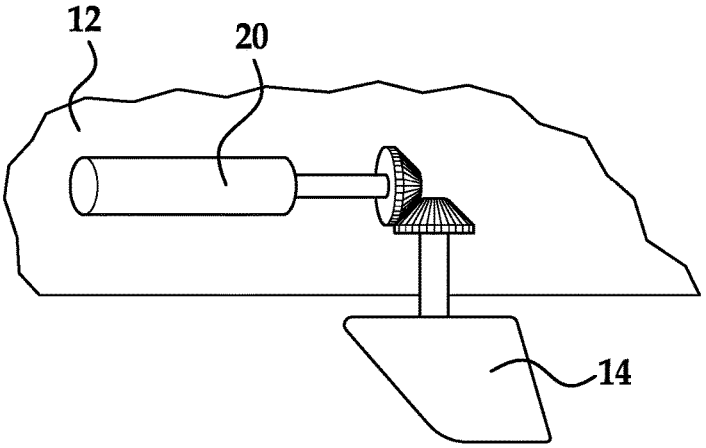
FIG. 4 is a cutaway side view illustrating a connection between an actuator and control surface of the flight vehicle of FIG. 1.

Referring now to FIG. 4, the actuators 20 may be electric motors that are operatively coupled to the control surfaces 14 in order to allow selective rotation of the control surfaces about their respective rotation axes 18. Output shafts of the electric motors may be directly coupled to the control surfaces 14, or indirectly coupled, such as through suitable gearing or other mechanisms, such that rotation of the output shafts of the actuator motors results in rotation of the corresponding control surfaces 14. Other suitable actuators may be used in place of electric motors.

While it is advantageous for the same actuators to be used both for atmospheric and exo-atmospheric attitude control, it is possible that different actuators may be used for atmospheric and exo-atmospheric operation. For example, pressurized gas from a stored-gas system may be used to power pistons or turbines, to turn the control surfaces in exo-atmospheric mode. Such as system may have the advantage of being able to achieve better angular accelerations on the control surfaces than would be achievable using the same actuators and connection method used in atmospheric operation. As another alternative separate gear trains for endo-atmospheric and exo-atmospheric modes of operation, to maximize the angular acceleration in exo-atmospheric mode.

Figure 5:
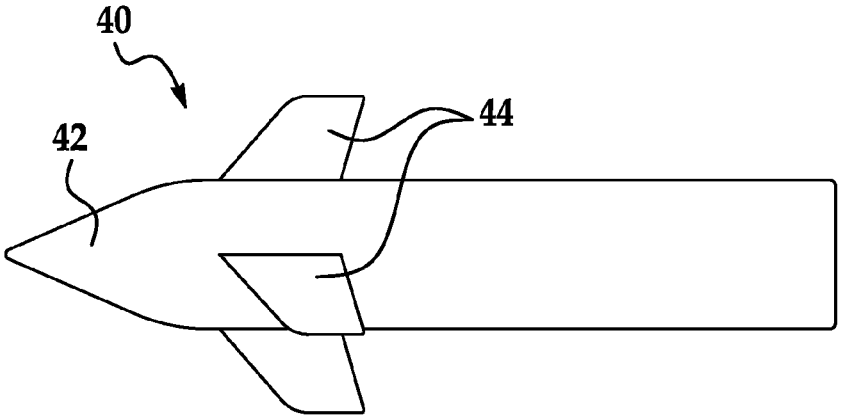
FIG. 5 is a schematic side view of a flight vehicle according to an alternate embodiment of the present invention.

FIG. 5 shows an alternative flight vehicle 40, which has rotatable control surfaces 44 at a front part of a fuselage 42. In different configurations, there may be any of a large variety of control surfaces on a flight vehicle fuselage, located at an aft end, a front end, or anywhere in between, at any combination of longitudinal locations along the fuselage. The control surfaces may have different types of actuators to move them, and may have different functions within an attitude control system, with for example only some of the control surfaces being operable as momentum or rotation wheels.

The control surfaces for the various embodiments may have any of a number of forms. Fins, canards, and wings are only a few possibilities. In addition it is possible that only parts of control surfaces may be rotatable, for example the distal tips of control surfaces.

Figure 6:
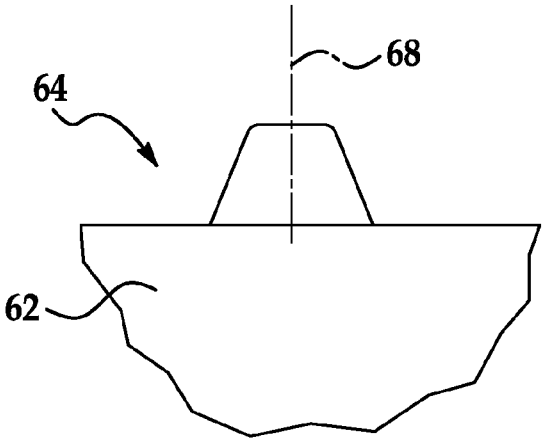
FIG. 6 is a schematic side view of a reconfigurable control surface, usable as part of a flight vehicle according to another alternate embodiment of the present invention.
Figure 7:
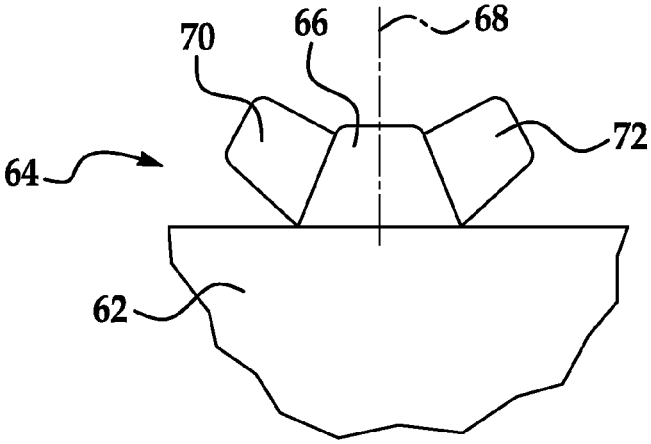
FIG. 7 is a schematic view of the control surface of FIG. 6, in a deployed configuration.

FIGS. 6 and 7 show a control surface 64 that is reconfigurable to change its moment of inertia $I_{cs}$. Increasing the moment of inertia increases the effect of the control surface 64 when used as a rotation wheel or momentum wheel. The control surface 64 includes a base 66 that is coupled to a shaft or whatever part the control surface 64 rotates about relative to a fuselage 62, such as on an axis of rotation 68. A pair of side panels 70 and 72 are hingedly coupled to opposite ends of the base 66. The control surface 64 may have a low-moment-of-inertia configuration, shown in FIG. 6, a stowed condition in which the side panels are relatively close to the axis of rotation 68, for example being folded over and overlapping the base 66.

FIG. 7 shows the control surface 64 in a deployed condition, with the side panels opened up away from the base 66. The control surface 64 in the deployed condition has a larger moment of inertia that does the control surface 64 in the stowed condition, shown in FIG. 6.

The side panels 70 and 72 may be initially held in the stowed condition by any of a variety of mechanisms, such as physical locking or retaining mechanisms. The side panels 70 and 72 may be released in any of a variety of suitable ways, in order to put the control surface 64 into the deployed configuration shown in FIG. 7. The shift from the stowed condition to the deployed condition may be made automatically when the attitude control system shifts from atmospheric operation to exo-atmospheric operation. Alternatively the shift from the stowed condition to the deployed condition may be made at a different time, such as after exo-atmospheric operation has begun.

The force for deploying the side panels 70 and 72, and/or for maintaining the side panels 70 and 72 in the deployed condition, may be chosen from any of a variety of suitable means. For example, the hinged side panels 70 and 72 may be spring-loaded, so that they move to the deployed condition, and are maintained there, when released. Other possible mechanisms for deploying the side panels 70 and 72 include pneumatics and small explosive charges, to be used to push a piston or otherwise operate one or more actuators to deploy the panels 70 and 72. Another possibility is to use a spring-loaded hinge configured such that in endo-atmospheric flight air pushes against the panel to keep it closed, with the hinge opening when the aerodynamic forces are sufficiently low. A further possibility is to have a trigger mechanism on the fuselage, such that when the fins are rotated sufficiently (such as to a certain configuration that would not be achieved in endo-atmospheric flight), the fins contact this trigger and pop open.

The control surface 64 may be used for some or all of the control surfaces 14 (FIG. 1) and/or the control surfaces 44 (FIG. 5) that have been described above. Control surfaces that are able to change their moment of inertia by changing configuration may have configuration changes that act only in one direction (such as from stowed condition to deployed condition), or alternatively may have configuration changes that are reversible (from stowed to deployed, and back again).

Many alternative arrangements are possible for a control surface that changes its moment of inertia by changing configuration. As an alternative to hinged panels, a control surface may have spring loaded parts that deploy from cavities in a base part of a control surface, to give one example. Another alternative would be masses movable within a control surface, with such masses relocated for exo-atmospheric mode to be located farther from a center of rotation.

As mentioned above, it is possible for the control surfaces 14 (FIG. 1) to operate as momentum wheels even when they have limits to their travel. For example a pair of diametrically-opposed control surfaces, two of the control surfaces 14, may be used sequentially to continue movement of the fuselage 12 even after one of the control surfaces 14 approaches or reaches a stop that limits its movement. First one of the diametrically-opposed control surfaces 14 can start rotating, causing the fuselage 12 to counter-rotate in the opposite direction. When this first control surface approaches its stop it can be decelerated, and even moved in the opposite direction, while at the same time the opposite control surface is rotated in the same sense (direction) that the first control surface was originally rotated. This can be done in such a way in order to maintain the desired movement of the fuselage 12. The principle of using multiple control surfaces sequentially may be applied even if the control surfaces in question do not have the same axis of rotation, and/or are not diametrically opposed.

Figure 8:
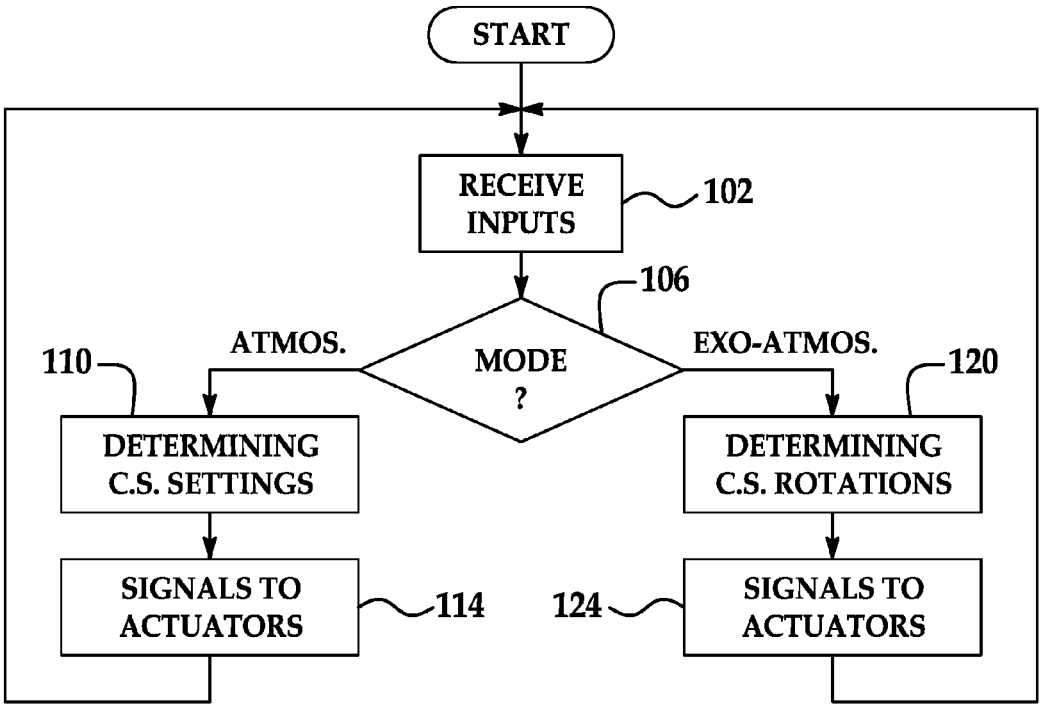
FIG. 8 is a high-level flow chart of operation of an attitude control system of a flight vehicle, according to an embodiment of the present invention.

FIG. 8 shows a high-level flow chart of a method 100 for attitude adjustment of the flight vehicle 10 (FIG. 1). The controller 22 (FIG. 1) receives inputs 102 that assist in the decision-making process of what mode to operate in (atmospheric or exo-atmospheric) and how to actuate the control surfaces 14 to achieve a desired orientation of the flight vehicle 10 or part of the flight vehicle (e.g., a greater part of the flight vehicle 10, such as the fuselage 12 (FIG. 1)). The inputs 102 may include inputs regarding positions and/or rotation rates of the control surfaces 14 (FIG. 1) and the fuselage 12. These inputs may be generated by suitable sensors, such as an inertial measurement unit in the fuselage 12, and position indicators of the control surfaces 14 that indicate the position of the control surfaces 14 relative to the fuselage 12. The time history of these sensors may be used to generate rotation rates of the fuselage 12 and/or the control surfaces 14.

The controller 22 (FIG. 1) also may receive an input or inputs that are used in determining whether the flight vehicle 10 (FIG. 1) is within the atmosphere or is above the atmosphere (in the exo-atmospheric region). Such inputs may come from an altitude sensor, or simply from a time of flight (combined with a knowledge of the intended or actual flight path). Data that may be used in determining a height may include data from a global positioning system (GPS), or integrated data from an inertial measurement unit (IMU).

The inputs 102 may also include other information, and/or such information may be accessible by the controller 22 (FIG. 1) before and/or during flight. Information on a desired flight path may be stored in the controller 22 (or accessible by the controller 22) prior to launch of the flight vehicle 10. Alternatively, the flight vehicle 10 may determine or update a flight path using information received during flight. For example an onboard sensor may be used to track a stationary or moving target. As another example the flight vehicle 10 may receive communications from an external system, such as a tracking system tracking the flight vehicle and/or a stationary or moving target (destination) for the flight vehicle 10.

In step 106 the controller 22 (FIG. 1) makes a determination of a mode in which to operate. The determination of mode may be predetermined, based for instance on time of flight, or may be determined actively during flight. An active determination may be made substantially continually, or may be made at only periodically during flight, for instance at set intervals that are greater than an interval at which control signals are updated.

If the controller 22 (FIG. 1) is operating in atmospheric mode it makes a determination in step 110 of the control surface settings to achieve a desired orientation for the flight vehicle 10 (FIG. 1). These control surface settings are translated in step 114 into control signals to be sent to one or more of the actuators 20 (FIG. 1), if needed, and these signals are sent to the actuators 20. Then the process repeats with the receiving of inputs in step 102, as often as necessary throughout the flight of the flight vehicle 10.

If the controller 22 (FIG. 1) is operating in the exo-atmospheric mode it makes a determination in step 120 of the control surface rotations to achieve a desired orientation for the fuselage 12 (FIG. 1). These desired rotations are translated in step 124 into control signals to be sent to one or more of the actuators 20 (FIG. 1), if needed, to accelerate, decelerate, or maintain rotational velocity of the control surfaces 14 (FIG. 1), to act as momentum wheels to achieve desired reorientation of the fuselage 12. These signals are then sent to the actuators 20. Then the process repeats with the receiving of inputs in step 102, as often as necessary throughout the flight of the flight vehicle 10 (FIG. 1).

The systems and methods described above offer several advantages relative to prior ways of handling attitude control. Since the same components can be used for both atmospheric and exo-atmospheric attitude control there is savings in cost, complexity, weight, and space (volume), relative to systems that have different components for atmospheric and exo-atmospheric attitude control. There is no need to supplement standard control-surface atmospheric control systems with specific additional systems, such as thrusters that vent pressurized gas through nozzles, to accomplish exo-atmospheric attitude control. The same actuators can be used to accomplish both functions.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A flight vehicle comprising:

a fuselage;

control surfaces extending outside of the fuselage; and a controller operatively coupled to the control surfaces;

wherein the control surfaces are each able to rotate relative to the fuselage about a respective rotation axis;

wherein the controller is capable of using the control surfaces as momentum wheels, selectively rotating the control surfaces to change attitude of the fuselage;

wherein the control surfaces are capable of fully rotating about the respective rotation axes.

2. The flight vehicle of claim 1, wherein the control surfaces include fins.

3. The flight vehicle of claim 1, wherein the control surfaces extend out from a forward part of the fuselage.

4. The flight vehicle of claim 1, wherein the control surfaces extend out from an aft part of the fuselage.

5. The flight vehicle of claim 1, wherein the controller also is capable of selectively commanding changes in position of the control surfaces relative to the fuselage, during atmospheric flight.

6. The flight vehicle of claim 1, further comprising actuators that receive commands from the controller, and control movement of the control surfaces relative to the fuselage.

7. The flight vehicle of claim 6, wherein the actuators include electric motors operatively coupled to respective of the control surfaces, to rotate the control surfaces relative to the fuselage.

8. The flight vehicle of claim 1, wherein at least some of the control surfaces are able to change configuration during flight to increase moments of inertia of the at least some of the control surfaces, about the rotation axes of the at least some of the control surfaces.

9. The flight vehicle of claim 8, wherein each of the at least some of the control surfaces includes a base, and at least one panel hingedly coupled to the base.

10. The flight vehicle of claim 1, wherein the flight vehicle is a missile.

11. The flight vehicle of claim 1, wherein the flight vehicle is configured to fly both atmospherically and exo-atmospherically.

12. The flight vehicle of claim 1, the controller being capable of using the control surfaces as momentum wheels includes the controller being configured to selectively rotate the control surfaces to put a torque on the fuselage as a direct reaction to rotation of the control surfaces.

13. A flight vehicle comprising:

a fuselage; and an attitude control system that includes:

control surfaces extending outside of the fuselage;

actuators operatively coupled to respective of the control surfaces, to selectively rotate the control surfaces relative to the fuselage about respective rotation axes; and a controller operatively coupled to the actuators;

wherein the attitude control system is configured to selectively operate in an atmospheric mode or an exo-atmospheric mode, such that:

when the attitude control system is in atmospheric mode, the attitude control system selectively changes attitude of the flight vehicle by selectively changing positions of the control surfaces, to allow aerodynamic forces to put a torque on the flight vehicle; and when the attitude control system is in exo-atmospheric mode, the attitude control system selectively changes attitude of the fuselage by selectively rotating the control surfaces, to thereby put a torque on the fuselage as a direct reaction to the rotating of the control surfaces.

14. The flight vehicle of claim 13, wherein the control surfaces are capable of fully rotating about the respective rotation axes.

15. The flight vehicle of claim 13, wherein the control surfaces include fins.

16. The flight vehicle of claim 13, wherein the actuators are electric motors.

17. A method of operating a flight vehicle, wherein the method comprises:

atmospherically flying the vehicle; and exo-atmospherically flying the vehicle;

wherein the atmospherically flying the flight vehicle includes controlling attitude of the flight vehicle by selectively changing positions of control surfaces of the flight vehicle, to cause aerodynamic forces to put a torque on the flight vehicle; and wherein the exo-atmospherically flying the flight vehicle includes controlling attitude of a fuselage of the flight vehicle by selectively rotating the control surfaces, to thereby put a torque on the fuselage as a direct reaction to the rotating of the control surfaces.

18. The method of claim 17, wherein, during the exo-atmospherically flying of the flight vehicle, the selectively rotating the control surfaces causes the control surfaces to operate as momentum wheels.

19. The method of claim 17, wherein, during the exo-atmospherically flying of the flight vehicle, the selectively rotating the control surfaces includes selectively fully rotating the control surfaces about respective rotation axes of the control surfaces.

* * * * *